US010498076B2

(12) United States Patent
Lee et al.

(10) Patent No.: US 10,498,076 B2
(45) Date of Patent: Dec. 3, 2019

(54) CONNECTOR ASSEMBLY CONNECTING CABLES FOR POWER TRANSMISSION

(71) Applicant: KYUNG CHANG INDUSTRIAL CO., Ltd., Daegu (KR)

(72) Inventors: Chang Min Lee, Daegu (KR); Dae Won Lee, Daegu (KR); Kyung Nam Kim, Daegu (KR)

(73) Assignee: KYUNG CHANG INDUSTRIAL CO., Ltd., Daegu (KR)

( * ) Notice: Subject to any disclaimer, the term of this patent is extended or adjusted under 35 U.S.C. 154(b) by 0 days.

(21) Appl. No.: 16/232,876

(22) Filed: Dec. 26, 2018

(65) Prior Publication Data

US 2019/0229463 A1 Jul. 25, 2019

(30) Foreign Application Priority Data

Jan. 19, 2018 (KR) ..... 10-2018-0007244

(51) Int. Cl.
*H01R 13/627* (2006.01)

(52) U.S. Cl.
CPC ..... *H01R 13/6275* (2013.01); *H01R 13/6273* (2013.01)

(58) Field of Classification Search
CPC ..... H01R 13/6272; H01R 13/6273; H01R 13/6275; H01R 13/627
See application file for complete search history.

(56) References Cited

U.S. PATENT DOCUMENTS 3,450,424 A * 6/1969 Calisher ..... F16L 37/088 285/305
4,040,697 A * 8/1977 Ramsay ..... A61B 5/0416 439/268
5,326,272 A * 7/1994 Harhen ..... A61B 5/0416 439/859
5,895,298 A * 4/1999 Faupel ..... A61B 5/0416 439/729
6,386,596 B1 * 5/2002 Olson ..... F16L 37/0925 285/305

(Continued)

FOREIGN PATENT DOCUMENTS

JP 2002-093534 A 3/2002
KR 10-0891315 B1 4/2009
KR 10-2013-0062688 A 6/2013

OTHER PUBLICATIONS

Korean Intellectual Property Office, Office Action, Korean Application No. 10-2018-0007244, dated Nov. 23, 2018, 12 pages.

*Primary Examiner* — Harshad C Patel
(74) *Attorney, Agent, or Firm* — Fenwick & West LLP

(57) ABSTRACT

A connector assembly connecting cables for power transmission may be provided. The connector assembly includes: a first linking body connected to one cable; a second linking body connected to another cable; a coupling member which is coupled to the first linking body and the second linking body and includes a catching groove formed on one end thereof and a catching opening formed along a circumference of the other end thereof; and a spring which includes two L-shaped rods and a bridge connecting the L-shaped rods, the bridge being coupled to the catching groove when the spring is mounted on the coupling member, the two L-shaped rods being coupled to the catching opening.

16 Claims, 7 Drawing Sheets

(56) References Cited

U.S. PATENT DOCUMENTS

| | | | | |
|---|---|---|---|---|
| 7,214,107 | B2 * | 5/2007 | Powell | H01R 11/22 439/729 |
| 8,851,526 | B2 * | 10/2014 | Taylor | F02M 37/0017 285/305 |
| 9,226,680 | B1 * | 1/2016 | Kendricks | A61B 5/0416 |
| 9,397,428 | B2 * | 7/2016 | Retho | H01R 13/40 |
| 2005/0153593 | A1 * | 7/2005 | Takayanagi | F16L 37/088 439/352 |
| 2006/0099839 | A1 * | 5/2006 | Ishida | F16L 41/007 439/157 |
| 2006/0145475 | A1 * | 7/2006 | Walker | F16L 37/088 285/319 |
| 2011/0067225 | A1 * | 3/2011 | Bassaco | F16D 25/08 29/525.01 |

* cited by examiner

CONNECTOR ASSEMBLY CONNECTING CABLES FOR POWER TRANSMISSION

CROSS-REFERENCE TO RELATED APPLICATIONS

This application claims the benefit of Republic of Korea Patent Application No. 10-2018-0007244 filed on Jan. 19, 2018, which is incorporated by reference in its entirety.

BACKGROUND

Field

The present disclosure relates to a device for transmitting the power in mechanisms such as a vehicle, etc.

Description of the Related Art

In general, many types of cables or members are mounted on mechanisms such as a vehicle, etc. The cables or members which are used in mechanisms are connected and transmit the power.

For example, a gear shift is performed by operating a shift lever arranged on the driver's seat. The cable is mainly used as a connection member which transmits the power according to the operation of the shift lever to the transmission.

A connector device is employed to connect these cables. The power is transmitted through the connector device. A conventional connector device uses a method of fixing the cables and has a structure for focusing on the role of bidirectional power transmission. This connector device has a structure incapable of obtaining a free stroke between the cables and it is troublesome to use tools when separating the cables.

SUMMARY

One embodiment of the present disclosure is a connector assembly connecting cables for power transmission. The connector assembly includes: a first linking body connected to one cable; a second linking body connected to another cable; a coupling member which is coupled to the first linking body and the second linking body and includes a catching groove formed on one end thereof and a catching opening formed along a circumference of the other end thereof; and a spring which includes two L-shaped rods and a bridge connecting the L-shaped rods, the bridge being coupled to the catching groove when the spring is mounted on the coupling member, the two L-shaped rods being coupled to the catching opening.

The connector assembly may further include: a first socket member which receives the coupling member and has a first tubular portion through which the one cable passes; and a second socket member which has a second tubular portion through which the above-described another cable passes, the second socket member being inserted into the first socket member.

The first socket member may include a fastening portion which is formed on an outer surface of the first socket member and is fastened to the second socket member, and a stopper which is formed on the outer surface and limits insertion of the first socket member into the second socket member. The second socket member may have a fastening hole into which a portion of the fastening portion.

The first socket member may have an operation opening at a location where the coupling member is received.

The two L-shaped rods of the spring mounted on the coupling member may be exposed through the operation opening of the first socket member.

The second linking body may have a conical end and a pillar extending from the conical end. An area of a base of the conical end may be greater than an area of a base of the pillar.

The coupling member may include a first recess which is coupled to an end of the first linking body, and a second recess which is coupled to an end of the second linking body.

When the second linking body is coupled to the coupling member, the end of the second linking body may be spaced apart from a bottom of the second recess.

The coupling member may have a cylindrical shape.

The coupling member may be fixedly connected to the first linking body and may be coupled to the second linking body in an attachable and detachable manner.

The fastening portion may have a C-shape and both ends of the fastening portion may be coupled to the outer surface of the first socket member.

The fastening portion may further include a manually pressing portion which is formed to protrude from the fastening portion and allows the fastening portion to be easily pressed.

The coupling member may include a fastening support rib which is formed on an outer surface of the coupling member in a longitudinal direction of the coupling member and supports the coupling of the coupling member and the first socket member. The first socket member may include a fastening support groove which is formed in an inner surface of the first socket member in a longitudinal direction of the first socket member and is coupled to the fastening support rib.

The first tubular portion may include a support which is formed along an inner circumferential surface of the first tubular portion and supports the one cable.

The first socket member may include a receiver which is formed to protrude outward to receive the fastening portion of the second socket member.

The first socket member and the second socket member may have a cylindrical shape. The first socket member may include a fastening support groove which supports fastening of the first socket member and the second socket member along an outer surface of the first socket member. The first socket member may include a fastening ring which is mounted in the fastening support groove.

DETAILED DESCRIPTION

Embodiments of the present disclosure will be described in more detail with reference to the accompanying drawings. In the components of the present disclosure, detailed descriptions of what can be clearly understood and easily carried into practice through prior art by those skilled in the art will be omitted to avoid making the subject matter of the present invention unclear.

Figure 1:
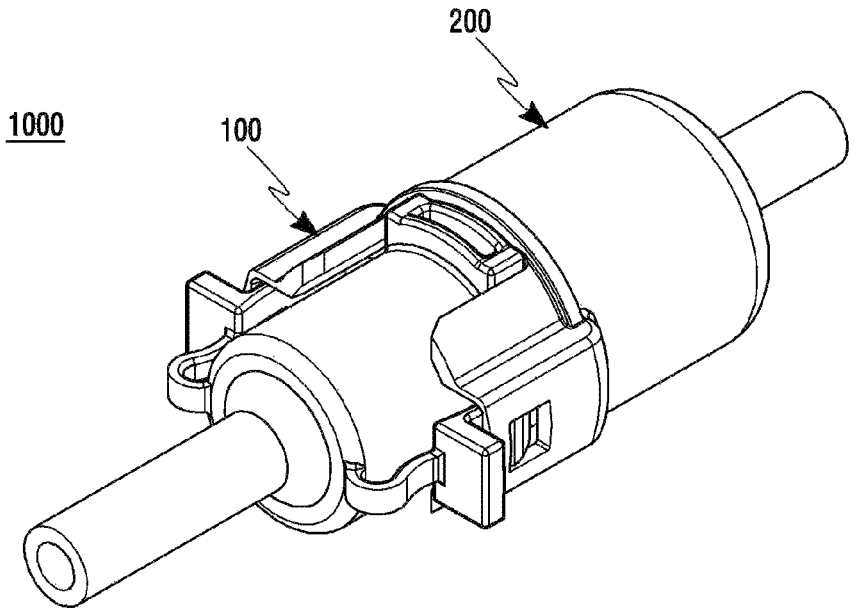
FIG. 1 is a view showing a connector assembly according to an embodiment of the present disclosure.
Figure 2:
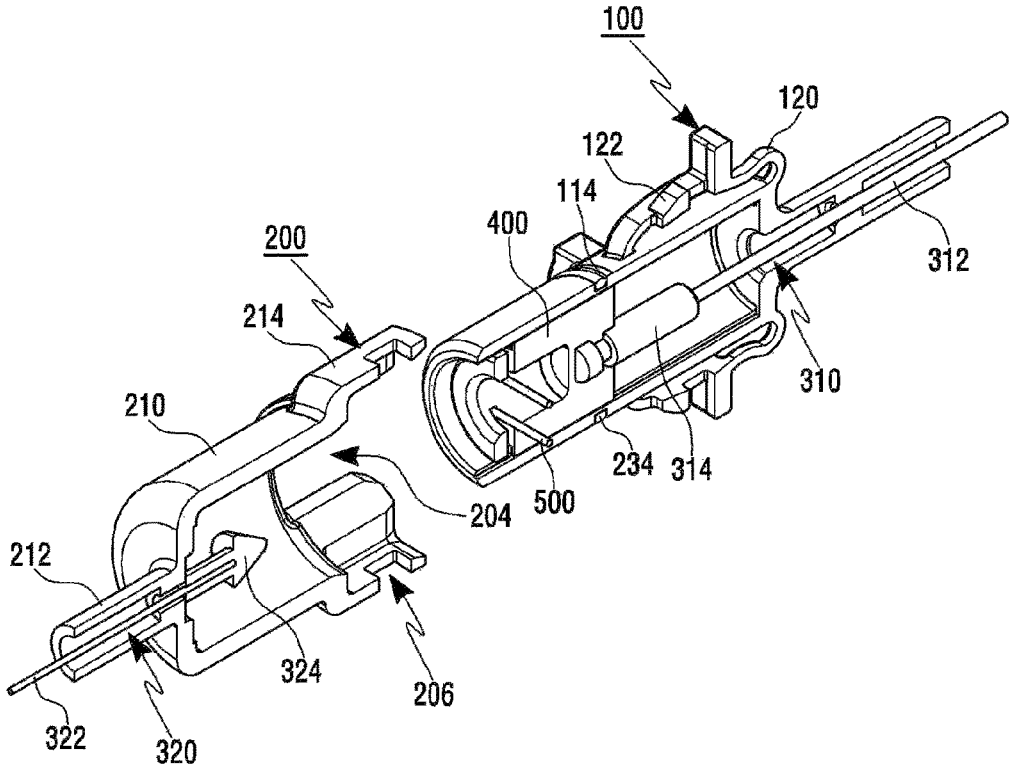
FIG. 2 is a sectional perspective view of the connector assembly in which a first socket member and a second socket member have been separated from each other according to an embodiment of the present disclosure.
Figure 3:
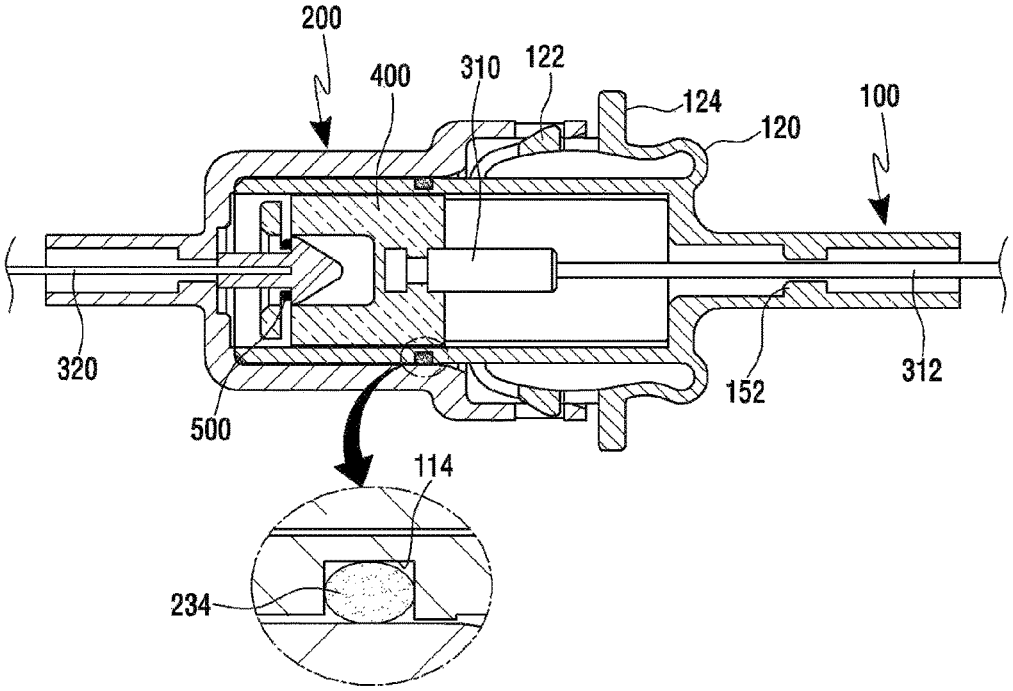
FIG. 3 is a sectional front view of the connector assembly in which the first socket member and the second socket member have been connected to each other according to an embodiment of the present disclosure.

FIG. 1 is a view showing a connector assembly according to an embodiment of the present disclosure. FIG. 2 is a sectional perspective view of the connector assembly in which a first socket member and a second socket member have been separated from each other according to an embodiment of the present disclosure. FIG. 3 is a sectional front view of the connector assembly in which the first socket member and the second socket member have been connected to each other according to an embodiment of the present disclosure.

Referring to FIG. 1 and FIG. 2, a connector assembly 1000 connects cables for power transmission among vehicle parts and includes a first socket member 100 and a second socket member 200. The first socket member 100 is connected to one cable 312 (shown in FIG. 2), and the second socket member 200 is connected to another cable 322 (shown in FIG. 2).

The cable 312 is connected to a first linking body 314 to form a first cable portion 310. The cable 322 is connected to a second linking body 324 to form a second cable portion 320 is formed.

The first cable portion 310 is mounted on the first socket member 100, and second cable portion 320 is mounted on the second socket member 200. In order to connect the first cable portion 310 and the second cable portion 320, the first socket member 100 is inserted and fastened to the second socket member 200.

The first socket member 100 receives a coupling member 400 and has a first tubular portion 112 through which the cable 312 passes. The second socket member 200 has a second tubular portion 212 through which the cable 322 passes. In one embodiment, the first socket member 100 and the second socket member 200 have a cylindrical shape.

The first linking body 314 and the second linking body 324 are coupled to the coupling member 400 in such a manner as to interlock with each other. In other words, the coupling member 400 is coupled to the first cable portion 310 and the second cable portion 320 such that the first cable portion 310 and the second cable portion 320 can transmit power.

Figure 4:
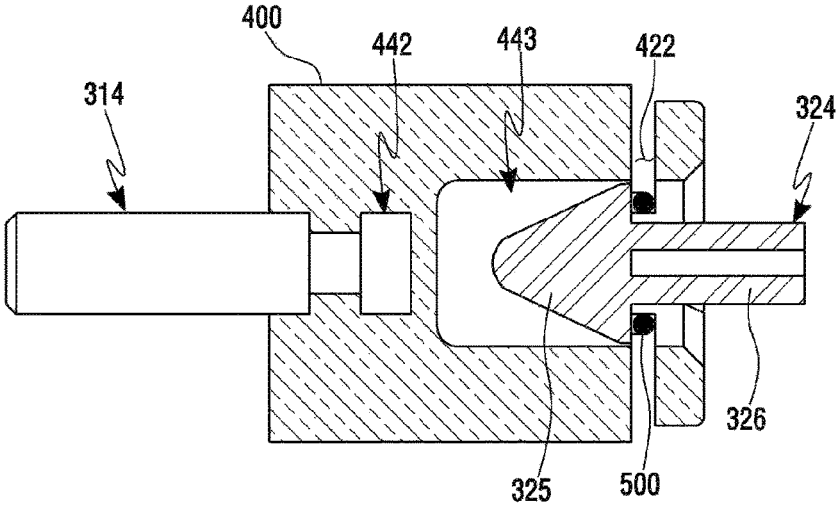
FIG. 4 is a cross sectional view of a coupling member fastened to a first linking body and a second linking body in accordance with the embodiment of the present disclosure.
Figure 5:
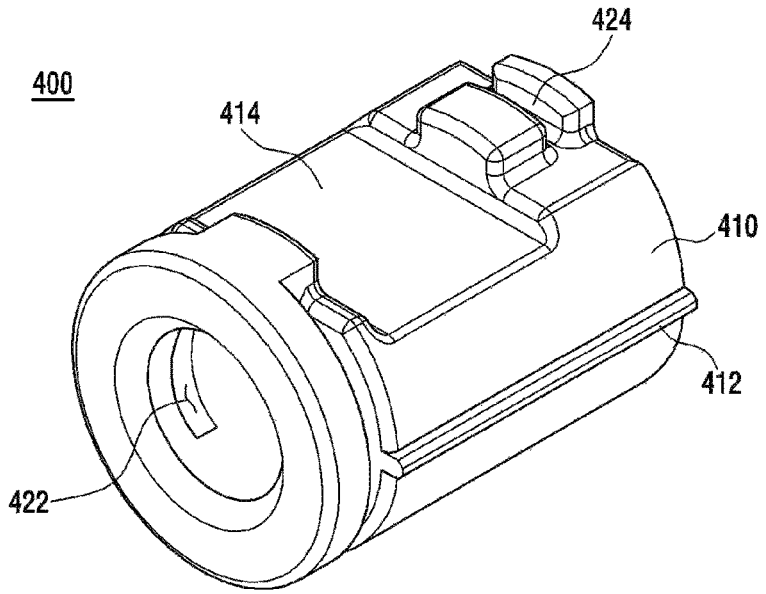
FIG. 5 is a perspective view showing the coupling member according to the embodiment of the present disclosure.

FIG. 4 is a cross sectional view of the coupling member fastened to the first linking body 314 and the second linking body 324 in accordance with the embodiment of the present disclosure. FIG. 5 is a perspective view showing the coupling member according to the embodiment of the present disclosure.

Referring to FIGS. 4 and 5, the coupling member 400 has a first recess 442 which is coupled to the end of the first linking body 314, and a second recess 443 which is coupled to the end of the second linking body 324. According to the embodiment, the coupling member 400 may have a cylindrical shape.

The coupling member 400 is fixedly connected to the end of the first linking body 314. Accordingly, the end of the first linking body 314 is formed to exactly fit the first recess 442. In the embodiment, the end of the first linking body 314 has a barbell shape. However, the shape of the end of the first linking body 314 is not limited to this.

Also, the coupling member 400 is coupled to the end of the second linking body 324 in an attachable and detachable manner The second linking body 324 is formed such that, when the coupling member 400 is coupled to the end of the second linking body 324, the end of the second linking body 324 is spaced apart from the bottom of the second recess 443. That is to say, when the end of the second linking body 324 is inserted into the second recess 443, space is formed between the end of the second linking body 324 and the bottom of the second recess 443. This space serves as a cushion, and thus prevents the connector assembly 1000 from being sensitive to torque stiffness.

The second linking body 324 has a conical end 325 and a pillar 326 extending from the conical end 325. The area of a base of the conical end 325 is greater than the area of a base of the pillar 326.

The coupling member 400 has a catching groove 424 formed in the outer surface of one end thereof and a catching opening 422 formed along the circumference of the other end of the coupling member 400. A spring 500 is caught in the catching groove 424 and in the catching opening 422 of the coupling member 400.

The catching opening 422 may have a half-arc shape. Specifically, on the other end of the coupling member 400, that is, on the end to which the second linking body 324 is coupled, the catching opening 422 is formed along the outer surface of the coupling member 400.

Also, the coupling member 400 may include a fastening support rib 412 which is formed on the outer surface of the coupling member 400 in the longitudinal direction of the coupling member 400 and supports the coupling of the coupling member 400 and the first socket member 100. The fastening support rib 412 is coupled to a fastening support groove which is formed in the inner surface of the first socket member 100 in the longitudinal direction of the first socket member 100.

Also, the coupling member 400 may include a flat portion 414 which allows the spring 500 to be stably coupled to the coupling member 400 when the spring 500 is mounted on the coupling member 400. The flat portion 414 is formed by partially cutting the outer surface of the coupling member 400. The flat portion 414 supports the spring 500, and thus allows the spring 500 to be stably mounted on the coupling member 400.

Figure 6:
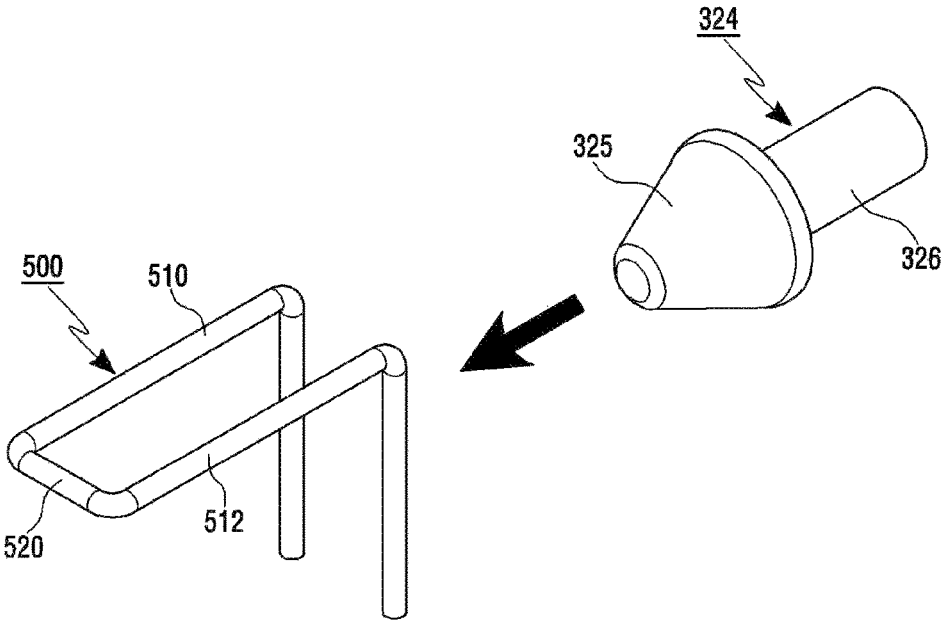
FIG. 6 is a perspective view showing a spring according to the embodiment of the present disclosure.
Figure 7:
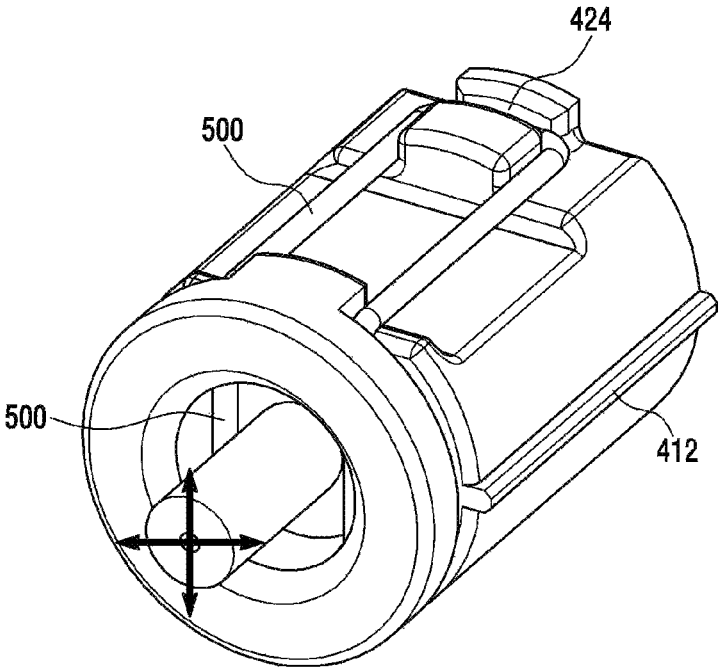
FIG. 7 is a view showing the spring mounted on the coupling member in accordance with the embodiment of the present disclosure.

FIG. 6 shows an example of the spring 500. FIG. 6 is a perspective view showing the spring according to the embodiment of the present disclosure. FIG. 7 is a view showing the spring mounted on the coupling member in accordance with the embodiment of the present disclosure.

Referring to FIGS. 6 and 7, the spring 500 has two L-shaped rods 510 and 512 and a bridge 520 which connects the two L-shaped rods 510 and 512. When the spring 500 is mounted on the coupling member 400, the bridge 520 is coupled to the catching groove 424 and the two L-shaped rods 510 and 512 are coupled to the catching opening 422. Accordingly, the two L-shaped rods 510 and 512 are positioned in the catching opening 422 in the width direction of the coupling member 400.

Accordingly, when the second linking body 324 passes through the catching opening 422 and is coupled to the coupling member 400, the spring 500 positioned in the width direction of the coupling member 400 fix the pillar 326 of the second linking body 324. Specifically, the two L-shaped rods 510 and 512 of the spring 500 are caught across the width direction of the coupling member 400 through the catching opening 422.

The two L-shaped rods 510 and 512 of the spring 500 fix the pillar 326 of the second linking body 324 across the width direction of the coupling member 400.

Accordingly, the end of the first linking body 314 is formed to exactly fit the catching opening 422. Also, the coupling member 400 is connected to the end of the second linking body 324 in an attachable and detachable manner.

When the first socket member 100 and the second socket member 200 are fastened to each other, the first socket member 100 is inserted into the second socket member 200, so that the second linking body 324 of the second cable portion 320, which is fixedly mounted in the second socket member, is inserted into and coupled to the coupling member 400 positioned within the first socket member 100. Since the end 325 of the second linking body 324 is conical, the end 325 passes through between the two L-shaped rods 510 and 512 mounted on the coupling member 400 and can be easily coupled to the coupling member 400.

Next, the first socket member and the second socket member will be described with reference to FIGS. 8 to 10.

Figure 8A:
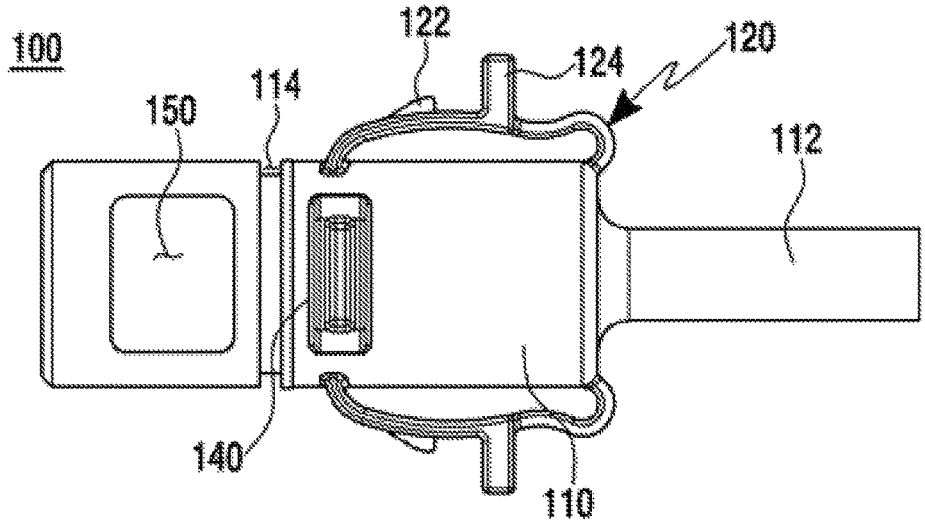
FIGS. 8A and 8B respectively show a front view and a perspective view of the first socket member according to the embodiment of the present disclosure.
Figure 8B:
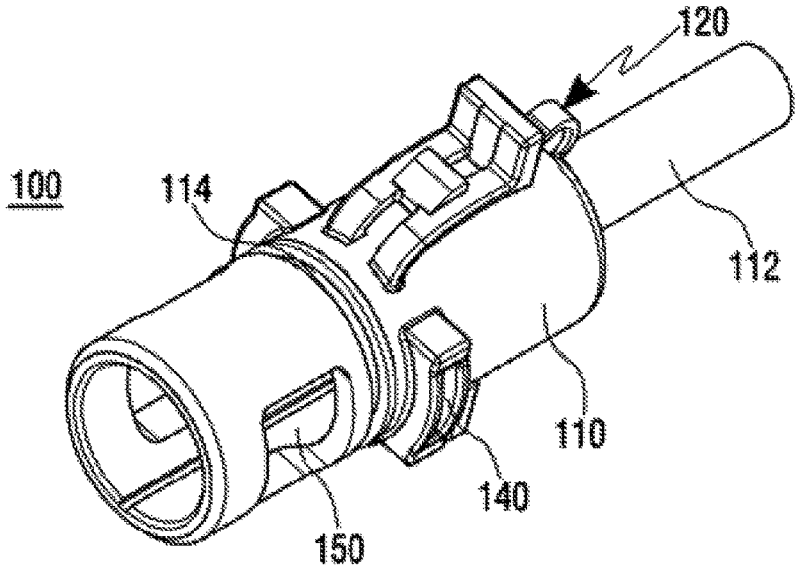

FIGS. 8A and 8B respectively shows a front view and a perspective view of the first socket member according to the embodiment of the present disclosure. FIG. 9 is a side view of the first socket member to which the coupling member on which the spring has been mounted has been fastened according to the embodiment of the present disclosure. FIG. 10 is a perspective view of the second socket member according to the embodiment of the present disclosure.

Referring to FIGS. 8A and 8B, the first socket member 100 is inserted and fastened to the second socket member 200. The first socket member 100 receives the coupling member 400 and has the first tubular portion 112 through which the cable 312 passes. The first tubular portion 112 may include a support 152 on the inner surface thereof to support the cable 312.

The first socket member 100 includes a fastening portion 120 and a stopper 140. The fastening portion 120 is formed on an outer surface 110 and is fastened to the second socket member 200. The stopper 140 is formed on the outer surface 110 and limits the insertion of the first socket member into the second socket member 200.

While the embodiment of the present disclosure shows that two fastening portions 120 are symmetrically installed on the outer surface 110 of the first socket member 100, the embodiment of the present disclosure is not limited to this.

The fastening portion 120 has a C-shape and both ends of the fastening portion 120 are coupled onto the outer surface 110 of the first socket member 100. The fastening portion 120 includes a protrusion 122 which is inserted into a fastening hole 206 of the second socket member 200 when the first socket member 100 and the second socket member 200 are coupled to each other. Also, the fastening portion 120 includes a manually pressing portion 124 which allows a user to easily press the fastening portion 120, in order for the fastening portion 120 to be separated from the fastening hole 206 when the user manually separates the first socket member 100 and the second socket member 200 from each other. The manually pressing portion 124 is formed to protrude from the fastening portion 120.

In the separation of the first socket member 100 of the first socket member 100 and the second socket member 200 which have been coupled to each other from the second socket member 200, when the protrusion 122 of the fastening portion 120 of the first socket member 100 is intended to be separated from the fastening hole 206 of the second socket member 200, the user presses the manually pressing portion 124, and thus the protrusion 122 of the fastening portion 120 of the first socket member 100 can be easily separated from the fastening hole 206 of the second socket member 200.

When the first socket member 100 is inserted and fastened to the second socket member 200, the stopper 140 limits the insertion of the first socket member 100 into the second socket member 200. A repulsive force against the force the first socket member 100 may apply to the second socket member 200 may be provided by the stopper 140. Therefore, the stopper 140 is formed along the circumference of the first socket member 100 and thus the contact area between the second socket member and the stopper is enlarged.

When the coupling member 400 is coupled to the first socket member 100 by the stopper 140 and the first socket member 100 is fastened to the second socket member 200, pressure which can be applied to the first linking body 314 and the second linking body 324 which have been coupled to the coupling member 400 is limited.

Also, the first socket member 100 has an operation opening 150 at a location where the coupling member 400 is received. When the coupling member 400 is coupled to the first socket member 100, the two L-shaped rods 510 and 512 of the spring 500 mounted on the coupling member 400 are exposed through the operation opening 150 of the first socket member 100.

Figure 9:
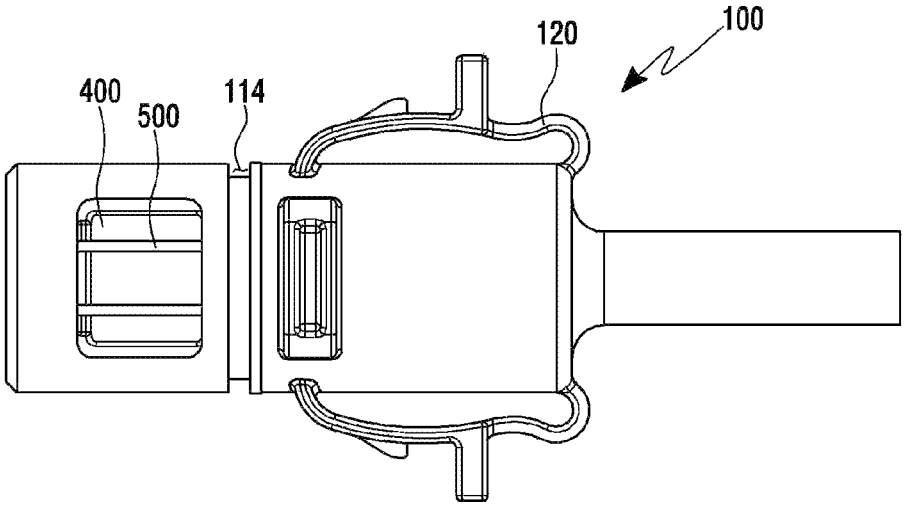
FIG. 9 is a side view of the first socket member to which the coupling member on which the spring has been mounted has been fastened according to the embodiment of the present disclosure.

Referring to FIG. 9, in the separation of the first socket member 100 of the first socket member 100 and the second socket member 200 which have been coupled to each other from the second socket member 200, even after the protrusion 122 of the fastening portion 120 of the first socket member 100 is separated from the fastening hole 206 of the second socket member 200, the second linking body 324 is being caught by the spring 500. In this case, the user spreads manually the two L-shaped rods 510 and 512 through the operation opening 150, thereby pulling out the second linking body 324 from the second recess 443.

In the embodiment, at the two fastening portions 120, the first socket member 100 is fastened to the second socket member 200. Also, the second linking body 324 is restricted to the coupling member 400 coupled to the first socket member 100 by the spring 500. Therefore, the first socket member 100 is hardly separated from the second socket member 200.

Also, the first socket member 100 may include a fastening support groove 114 which supports the fastening of the first socket member 100 and the second socket member 200 along the outer surface of the first socket member 100. In this case, the first socket member 100 may include a fastening ring 234 which is mounted in the fastening support groove 114. The fastening ring 234 is tightly fitted between the first socket member 100 and the second socket member 200, thereby reinforcing the fastening of the first socket member 100 and the second socket member 200.

Figure 10:
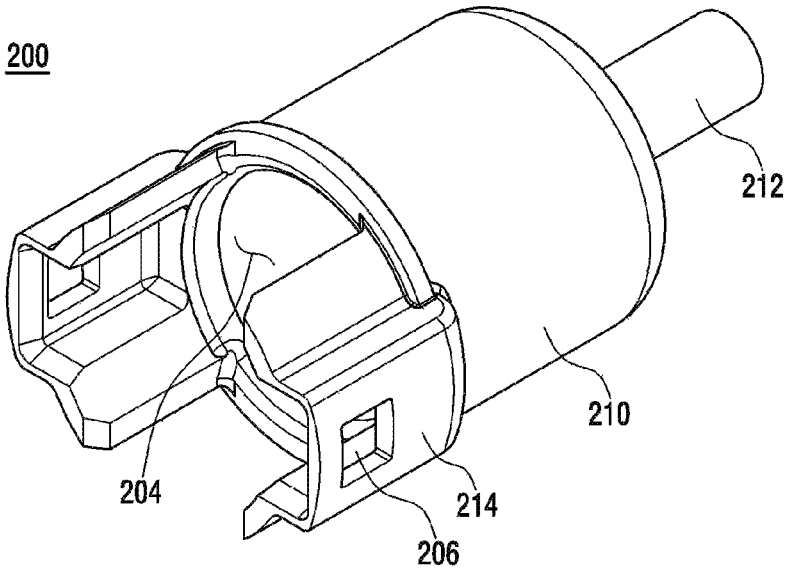
FIG. 10 is a perspective view of the second socket member according to the embodiment of the present disclosure.

Referring to FIG. 10, the second socket member 200 has a second tubular portion 212 through which the cable 322 passes. The first socket member 100 is inserted into the second socket member 200.

The second socket member 200 includes the fastening hole 206 at a location corresponding to the fastening portion 120 of the first socket member 100. The protrusion 122 of the fastening portion 120 is inserted and fastened to the fastening hole 206.

The fastening portion 120 of the first socket member 100 has a C-shape protruding on the outer surface of the first socket member 100. Therefore, for the purpose of receiving the fastening portion 120 of the first socket member 100 when the second socket member 200 is coupled to the first socket member 100, the second socket member 200 includes a receiver 214 formed to protrude outward from the circumference with respect to an outer surface 210 of the second socket member 200.

Also, the second socket member 200 includes an opening 204 at a location corresponding to the stopper 140 of the first socket member 100. Accordingly, when the first socket member 100 is inserted into the second socket member 200, the stopper 140 is located at the opening 204 of the second socket member 200.

According to the above-mentioned embodiments of the present disclosure, it is possible to provide the connector assembly which allows cables for power transmission to be manually separated without tools.

According to the embodiments of the present disclosure, it is possible to provide the connector assembly which supplies a free stroke between the cables for power transmission and improves the connection stability between the cables.

The features, structures and effects and the like described in the embodiments are included in at least one embodiment of the present disclosure and are not necessarily limited to one embodiment. Furthermore, the features, structures, effects and the like provided in each embodiment can be combined or modified in other embodiments by those skilled in the art to which the embodiments belong. Therefore, contents related to the combination and modification should be construed to be included in the scope of the present disclosure.

Although the embodiments of the present disclosure were described above, these are just examples and do not limit the present invention. Further, the present invention may be changed and modified in various ways, without departing from the essential features of the present disclosure, by those skilled in the art. For example, the components described in detail in the embodiments of the present disclosure may be modified. Further, differences due to the modification and application should be construed as being included in the scope and spirit of the present disclosure, which is described in the accompanying claims.

What is claimed is:

1. A connector assembly connecting cables for power transmission, the connector assembly comprising:

a first linking body connected to one cable;

a second linking body connected to another cable;

a coupling member which is coupled to the first linking body and the second linking body and comprises a catching groove formed on one end thereof and a catching opening formed along a circumference of another end thereof; and a spring which comprises two L-shaped rods and a bridge connecting the L-shaped rods, the bridge being coupled to the catching groove when the spring is mounted on the coupling member, the two L-shaped rods being coupled to the catching opening.

2. The connector assembly of claim 1, further comprising:

a first socket member which receives the coupling member and has a first tubular portion through which the one cable passes; and a second socket member which has a second tubular portion through which the another cable passes, the second socket member being inserted into the first socket member.

3. The connector assembly of claim 2, wherein the first socket member comprises a fastening portion which is formed on an outer surface of the first socket member and is fastened to the second socket member, and a stopper which is formed on the outer surface and limits insertion of the first socket member into the second socket member, and wherein the second socket member has a fastening hole into which a portion of the fastening portion is inserted.

4. The connector assembly of claim 3, wherein the first socket member has an operation opening at a location where the coupling member is received.

5. The connector assembly of claim 4, wherein the two L-shaped rods of the spring mounted on the coupling member are exposed through the operation opening of the first socket member.

6. The connector assembly of claim 3, wherein the fastening portion has a C-shape and both ends of the fastening portion are coupled to the outer surface of the first socket member.

7. The connector assembly of claim 3, wherein the fastening portion further comprises a manually pressing portion which is formed to protrude from the fastening portion and allows the fastening portion to be easily pressed.

8. The connector assembly of claim 3, wherein the coupling member comprises a fastening support rib which is formed on an outer surface of the coupling member in a longitudinal direction of the coupling member and supports the coupling of the coupling member and the first socket member, and wherein the first socket member comprises a fastening support groove which is formed in an inner surface of the first socket member in a longitudinal direction of the first socket member and is coupled to the fastening support rib.

9. The connector assembly of claim 3, wherein the first socket member comprises a receiver which is formed to protrude outward to receive the fastening portion of the second socket member.

10. The connector assembly of claim 2, wherein the first tubular portion comprises a support which is formed along an inner circumferential surface of the first tubular portion and supports the one cable.

11. The connector assembly of claim 1, wherein the second linking body has a conical end and a pillar extending from the conical end, and wherein an area of a base of the conical end is greater than an area of a base of the pillar.

12. The connector assembly of claim 1, wherein the coupling member comprises a first recess which is coupled to an end of the first linking body, and a second recess which is coupled to an end of the second linking body.

13. The connector assembly of claim 12, wherein, when the second linking body is coupled to the coupling member, the end of the second linking body is spaced apart from a bottom of the second recess.

14. The connector assembly of claim 1, wherein the coupling member has a cylindrical shape.

15. The connector assembly of claim 1, wherein the coupling member is fixedly connected to the first linking body and is coupled to the second linking body in an attachable and detachable manner.

16. The connector assembly of claim 1, wherein the first socket member and the second socket member have a cylindrical shape, wherein the first socket member comprises a fastening support groove which supports fastening of the first socket member and the second socket member along an outer surface of the first socket member, and wherein the first socket member comprises a fastening ring which is mounted in the fastening support groove.

* * * * *